US009153162B2

(12) United States Patent
Chung

(10) Patent No.: US 9,153,162 B2
(45) Date of Patent: Oct. 6, 2015

(54) PIXEL, DISPLAY DEVICE COMPRISING THE PIXEL AND DRIVING METHOD OF THE DISPLAY DEVICE

(71) Applicant: SAMSUNG DISPLAY CO., LTD., Yongin, Gyeonggi-Do (KR)

(72) Inventor: Kyung-Hoon Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 244 days.

(21) Appl. No.: 13/870,948

(22) Filed: Apr. 25, 2013

(65) Prior Publication Data

US 2014/0192037 A1 Jul. 10, 2014

(30) Foreign Application Priority Data

Jan. 8, 2013 (KR) ..... 10-2013-0002138

(51) Int. Cl.
*G09G 5/00* (2006.01)
*G09G 3/20* (2006.01)
*G09G 3/32* (2006.01)

(52) U.S. Cl.
CPC ..... *G09G 3/2022* (2013.01); *G09G 3/3233* (2013.01); *G09G 3/3266* (2013.01); *G09G 2300/0814* (2013.01); *G09G 2300/0819* (2013.01); *G09G 2300/0842* (2013.01); *G09G 2300/0861* (2013.01); *G09G 2310/0245* (2013.01); *G09G 2310/063* (2013.01)

(58) Field of Classification Search
CPC ..... G09G 3/32; G09G 5/00; H04N 13/04; G06F 3/038
USPC ..... 345/76, 82, 211, 212
See application file for complete search history.

(56) References Cited

U.S. PATENT DOCUMENTS

2013/0106828 A1* 5/2013 Kim ..... 345/212
2013/0127815 A1* 5/2013 Yoo ..... 345/212
2013/0249883 A1* 9/2013 Hwang ..... 345/212
2013/0335396 A1* 12/2013 Kim ..... 345/212

FOREIGN PATENT DOCUMENTS

KR 10-2005-0109163 A 11/2005
KR 10-2008-0090954 A 10/2008
KR 10-2011-0013693 A 2/2011

* cited by examiner

*Primary Examiner* — Pegeman Karimi
(74) *Attorney, Agent, or Firm* — Christie, Parker & Hale, LLP

(57) ABSTRACT

A display device includes a data driver; a scan driver; a compensation control signal unit configured to reset voltages of data signals transmitted to a plurality of pixels during a previous frame at a current frame, and configured to generate and transmit a first control signal to compensate for threshold voltages of driving transistors of the pixels and a second control signal to control simultaneous light emission of the pixels; a power controller configured to control and supply the voltage levels of a first and second power source voltages; a display unit including the plurality of pixels coupled to corresponding data lines, scan lines, first control lines, second control lines, first voltage lines, and second voltage lines; and a timing controller configured to generate a plurality of data signals by processing external image signals and generate a plurality of driving control signals for controlling driving of the drivers.

31 Claims, 7 Drawing Sheets

PIXEL, DISPLAY DEVICE COMPRISING THE PIXEL AND DRIVING METHOD OF THE DISPLAY DEVICE

CROSS-REFERENCE TO RELATED APPLICATION

This application claims priority to and the benefit of Korean Patent Application No. 10-2013-0002138, filed in the Korean Intellectual Property Office on Jan. 8, 2013, the entire content of which is incorporated herein by reference.

BACKGROUND (a) Field

The following description relates to a pixel, a display device including the pixel, and driving method of the display device. More particularly, the following description relates to a pixel including an OLED (organic light emitting diode), an active matrix display device including the pixel, and a driving method of the display device.

(b) Description of the Related Art

One frame of the active matrix display device includes a scan period for programming image data and a light emission period for emitting light according to the programmed image data.

However, as the size and resolution of the display panel increases, the more the RC (resistive-capacitive) delay of the display panel increases. Accordingly, it takes more time to program image data in each pixel of the display panel, and it becomes more difficult to drive the display device.

Further, driving the display becomes more difficult when the display device displays a stereoscopic image.

When displaying a stereoscopic image, for example, under the NTSC standard, the display device should alternately display sixty images for the left eye and sixty images for the right eye per second. Therefore, the driving frequency of the display device displaying a stereoscopic image is at least two or more times that of the display device displaying a plane image.

Because data programming should be finished within at least 1/120 of a second when a stereoscopic image is displayed, a drive that scans the entire display panel during a single scan period and operates at a high driving frequency to program image data is required. A driver with a high driving frequency causes the manufacturing cost to be increased.

Further, the larger the area of the display panel, the larger the area that the organic light emitting diode (OLED) occupies, and therefore, the parasitic capacitance increases such that the compensation time for the threshold voltage increases, which reduces light emitting duty. Thus, the power consumption of the display panel may be increased.

Further, a backward voltage is applied to an organic light emitting element while driving during a reset period, potentially causing black spots to appear on the display, and black spots may also appear during a compensation period for the threshold voltage. Further, a swing in the power source voltage during the driving may influence the operations of various other control signals due to coupling, and a deterioration of the image quality of the display, such as loading of a dark part, due to the coupling may occur.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention are directed toward a pixel, a display device including the pixel, and a driving method of the display device having decreased time to compensate for a threshold voltage of a driving transistor due to low capacitance of a large OLED display panel, preventing application of a backward voltage to an OLED during driving, and lowering or minimizing negative effects due to swing of a driving power source voltage.

More particularly, aspects of an embodiment of the present invention is directed toward preventing the occurance of black spots in an image by lowering or minimizing an influence of swing of a driving power source voltage on other signals due to coupling and thus, displaying a clearer image with high image quality.

An embodiment of the present invention provides a display device including: a data driver configured to transmit a plurality of data signals; a scan driver configured to generate and transmit a plurality of scan signals; a compensation control signal unit configured to reset voltages of data signals transmitted to a plurality of pixels during a previous frame at a current frame and configured to generate and transmit a first control signal to compensate for threshold voltages of driving transistors of the pixels and a second control signal to control simultaneous light emission of the pixels; a power controller configured to control and supply a first power source voltage and a second power source voltage; a display unit including a plurality of pixels coupled to corresponding ones of a plurality of data lines configured to transmit the data signals, to corresponding ones of a plurality of scan lines configured to transmit the plurality of scan signals, to a first control line configured to transmit the first control signal, to a second control line configured to transmit the second control signal, to a first voltage line configured to transmit the first power source voltage, and to a second voltage line configured to transmit the second power source voltage; and a timing controller configured to generate the data signals by processing external image signals and generate a plurality of driving control signals for controlling driving of each of the data driver, the scan driver, the compensation control signal unit, and the power controller.

The compensation control signal unit may be further configured to generate and transmit a third control signal for controlling transmission of data voltages stored in the plurality of pixels according to the data signals of the previous frame to gate electrodes of the driving transistors of the pixels.

The scan driver may be further configured to sequentially transmit the plurality of scan signals to corresponding scan lines of corresponding pixel lines of the pixels, and the data driver may be further configured to sequentially transmit corresponding data signals of the current frame through the plurality of data lines to the plurality of pixels respectively activated by the plurality of scan signals.

The plurality of pixels in the display unit may be configured to simultaneously display images according to data voltages according to corresponding ones of a plurality of data signals of the current frame in response to the second control signal.

The scan driver may be further configured to sequentially transmit the scan signals to scan lines corresponding to pixel lines of the plurality of pixels, and the data driver may be further configured to sequentially transmit corresponding ones of the plurality of data signals of the current frame to a plurality of pixels respectively activated by the plurality of scan signals during a first period, the pixels in the display unit may be configured to simultaneously display images according to the plurality of data signals programmed during the previous frame according to the second control signal during a second period, the second period overlapping the first period.

The second period may be the same as the first period.

The data signals may be first view point image data signals or second view point image data signals and correspond to the current frame, and the view points of the first image data signals and the second image data signals may be different from each other.

Each of the plurality of pixels may include: an organic light emitting diode; a driving transistor electrically coupled to the first voltage line and configured to supply a driving current to the organic light emitting diode; a switching transistor coupled to the corresponding data line and configured to transmit a data voltage according to the data signal of the current frame to a gate electrode of the driving transistor; a compensation transistor coupled to a gate electrode and a drain electrode of the driving transistor and configured to diode-connect the driving transistor for a period in one frame; a light emission control transistor coupled between the driving transistor and the organic light emitting diode and configured to control supply of the driving current; a compensation capacitor coupled to the gate electrode of the driving transistor; and a storage capacitor including one electrode coupled to the compensation capacitor and another electrode coupled to the first voltage line, and the organic light emitting diodes of the pixels configured to simultaneously emit light for a first period when the light emission control transistors are turned on.

The plurality of pixels may each further include: a transmission transistor located between the switching transistor and a node connecting the storage capacitor and the compensation capacitor, and may be configured to transmit, during the current frame, a data voltage of the data signal of the previous frame through the switching transistor; a holding transistor may be located between the corresponding data line and the node and configured to apply a reference voltage through the data line to the node; and a holding capacitor including one electrode coupled to a source electrode of the transmission transistor and another electrode coupled to a gate electrode of the holding transistor, and may be configured to store a data voltage according to the data signal of the current frame for a time.

The plurality of pixels may each be configured to simultaneously emit light during a light emission period of the current frame according to a data voltage according to the data signal of the previous frame which is transmitted by the transmission transistor, and may be configured to simultaneously emit light during a light emission period of a next frame according to a data voltage according to the data signal of the current frame which is stored by the holding capacitor.

The holding transistor may be configured to be turned on and apply the reference voltage to the node for the period when the voltages according to the data signals of the previous frame are reset.

A fourth period when the light emission transistor is turned off may include: a reset period when the voltages according to the data signals of the previous frame are reset; a compensation period when the threshold voltages of the driving transistors of the pixels are compensated for, and a writing period when the pixels are activated by scan signals and the data voltages according to the data signals of the current frame are programmed.

A fifth period when the light emission transistor is turned off may include: a reset period when the voltages according to the data signals of the previous frame are reset; a compensation period when the threshold voltages of the driving transistors of the pixels are compensated for, and a transmission period when the data voltages according to the data signals programmed and stored during the previous frame are transmitted to the gate electrodes of the driving transistors of the pixels, and the first period overlaps a writing period when the pixels are activated by scan signals and the data voltages according to the data signals of the current frame are programmed.

The switching transistor may be configured to be turned on and transmit the reference voltage to the gate electrodes of the driving transistors through the corresponding data lines during the period when the voltages according to the data signals of the previous frame are reset, before transmitting the data voltages according to the data signals of the current frame.

Another embodiment of the present invention provides a pixel including: an organic light emitting diode; a first transistor electrically coupled to a first power source voltage and configured to supply a driving current to the organic light emitting diode; a second transistor coupled to a corresponding one of a plurality of data lines and configured to transmit a data voltage according to a data signal of one frame to a gate electrode of the first transistor; a third transistor coupled to a gate electrode and a drain electrode of the first transistor and configured to diode-connect the first transistor for a period in one frame; a fourth transistor coupled between the first transistor and the organic light emitting diode and configured to control supply of the driving current; a first capacitor coupled to the gate electrode of the first transistor; and a second capacitor including one electrode coupled to the first capacitor and another electrode coupled to the first power source voltage. While the fourth transistor is turned off, a voltage according to a data signal of a previous frame is reset, the third transistor is configured to be turned on and the threshold voltage of the first transistor is compensated for, and the second transistor is configured to be turned on and a data voltage according to a data signal of the one frame is programmed, and while the fourth transistor is turned on, the organic light emitting diode is configured to emit light by according to the driving current.

The second transistor may be configured to be turned on and may transmit a reference voltage through the corresponding data line during the period when a voltage according to a data signal of the previous frame is reset.

The reference voltage may have a value in a range according to the data signal.

The first power source voltage may be supplied as a low-level voltage during the period when a voltage according to a data signal of the previous frame is reset.

During the one frame, a second power source voltage coupled to a cathode of the organic light emitting diode is supplied fixedly as a low-level voltage.

Yet another embodiment of the present invention provides a pixel including: an organic light emitting diode; a fifth transistor electrically coupled to a first power source voltage and configured to supply a driving current to the organic light emitting diode; a sixth transistor coupled to a corresponding one of a plurality of data lines and configured to transmit a data voltage according to a data signal of one frame to a gate electrode of the fifth transistor; a seventh transistor coupled to a gate electrode and a drain electrode of the fifth transistor and configured to diode-connect the fifth transistor for a period in the one frame; an eighth transistor coupled between the fifth transistor and the organic light emitting diode and configured to control supply of the driving current; a third capacitor coupled to the gate electrode of the fifth transistor; a fourth capacitor including one electrode coupled to the third capacitor and another electrode coupled to the first power source voltage; a ninth transistor located between the sixth transistor and a node connecting the third capacitor and the fourth capacitor, and configured to transmit a data voltage of the data signal of the previous frame of the one frame which is applied through the sixth transistor; a tenth transistor located between the corresponding data line and the node and configured to apply a reference voltage transmitted through the data line to the node; and a fifth capacitor including one electrode coupled to a source electrode of the ninth transistor and another electrode coupled to a gate electrode of the tenth transistor and configured to store a data voltage according to the data signal of the one frame for a time.

While the eighth transistor is turned on, the organic light emitting diode is configured to emit light according to the driving current.

While the eight transistor is turned off, a voltage according to a data signal of the previous frame of the one frame may be reset, the seventh transistor may be configured to be turned on and the threshold voltage of the fifth transistor may be compensated for, and the ninth transistor may be configured to be turned on and a data voltage according to a data signal of the previous frame is transmitted.

The first power source voltage may be supplied as a low-level voltage during the period when a voltage according to a data signal of the previous frame of the one frame is reset.

While the eighth transistor is turned on, the sixth transistor may be configured to be turned on and a data voltage according to the data signal of the one frame may be programmed through the corresponding data line.

The reference voltage that the tenth transistor transmits may have a value in a range according to the data signal.

During the one frame, a second power source voltage coupled to a cathode of the organic light emitting diode may be supplied fixedly as a low-level voltage.

Another embodiment of the present invention provides a method of driving a display device including a plurality of pixels each including an organic light emitting diode, a driving transistor coupled to a first power source voltage and supplying a driving current to the organic light emitting diode, a light emission control transistor located between the driving transistor and the organic light emitting diode and controlling light emission by the driving current, a compensation capacitor coupled to a gate electrode of the driving transistor, and a storage capacitor located between the compensation capacitor and the first power source voltage. The method includes: a reset act including discharging an anode voltage of the organic light emitting diode and applying a reference voltage to a gate electrode of the driving transistor; a compensation act including transmitting a voltage corresponding to the threshold voltage of the driving transistor to the compensation capacitor; a scan act including storing a data voltage according to a corresponding one of a plurality of data signals of one frame, into the storage capacitor; and a light emission act including emitting light through the organic light emitting diode according to a driving current corresponding to the voltage applied to the gate electrode of the driving transistor. The light emission control transistors of the pixels are simultaneously turned on, such that the light emission act of the pixels is simultaneously performed.

While the light emission control transistors of the pixels are simultaneously turned off, the reset act, the compensation act, and the scan act may be performed.

Alternatively, while the light emission control transistors of the pixels are simultaneously turned off, the reset act and the compensation act may be performed, and while the light emission control transistors of the pixels are simultaneously turned on, the light emission act of the pixels may overlap the scan act sequentially performed on each pixel line of the pixels.

The method may further include a transmission act including transmitting data voltages programmed according to the data signals of a previous frame in the pixels to the gate electrodes of the driving transistors of the pixels, after the compensation act.

The pixels may each emit light with a driving current according to the data voltage programmed according to the data signal of a previous frame during the simultaneous light emission act, and may receive and store a data voltage according to the data signal of the one frame in the scan act.

The first power source voltage may be supplied as a low-level voltage during the reset act.

While the reset act, the compensation act, the scan act, and the light emission act are performed, a second power source voltage coupled to a cathode of the organic light emitting diode may be supplied fixedly as a low-level voltage.

According to an embodiment of the present invention, it is possible to maintain or lower an increase in consumed power with a decrease in light emission duty due to an increase in time required to compensate for the threshold voltage due to the capacitance (or parasitic capacitance) of large OLEDs in a large-sized display panel.

Further, it is possible to prevent or reduce the loading or displaying of dark portions or dark spots due to a backward voltage being applied to OLEDs during driving, and prevent or reduce an influence on other signals due to swing of a driving power source voltage.

Therefore, it is possible to provide a display device that provides a clearer image with high image quality while consuming less power.

DETAILED DESCRIPTION

Figure 1:
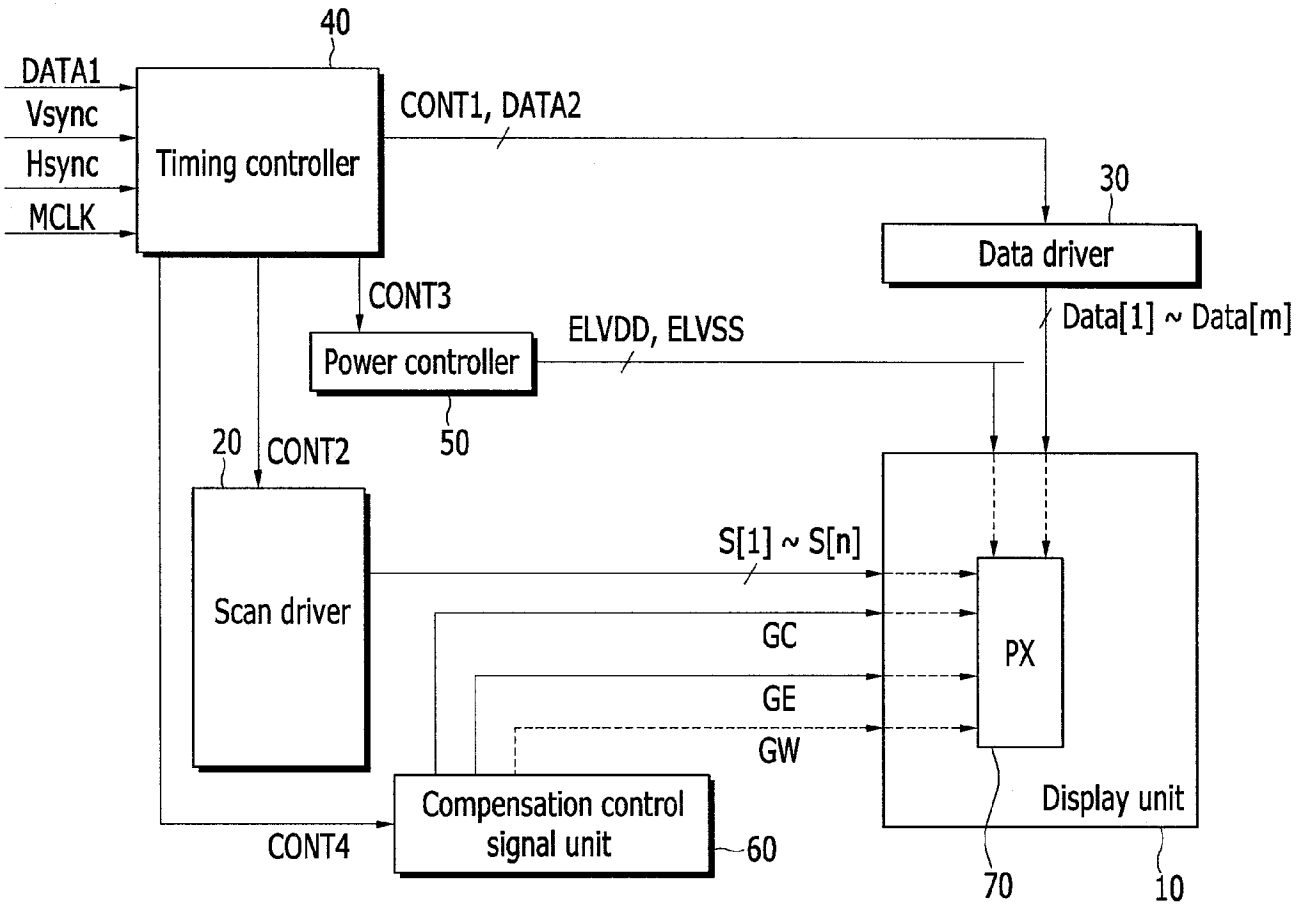
FIG. 1 is a block diagram illustrating the configuration of a display device according to an exemplary embodiment of the present invention.

Hereinafter, exemplary embodiments of the present invention will be described in more detail with reference to the accompanying drawings such that those skilled in the art can more easily practice the present invention. The present invention may be implemented in various ways and is not limited to the exemplary embodiments described herein.

The parts unrelated to the description of the exemplary embodiments are not shown to make the description more clear, and like reference numerals designate like elements throughout the specification.

Throughout this specification and the claims that follow, when an element is described as "coupled" or "connected" to another element, the element may be "directly coupled" or "directly connected" to the other element or "electrically coupled" or "electrically connected" to the other element through one or more third elements. In addition, unless explicitly described to the contrary, the word "comprise" and variations such as "comprises" or "comprising" will be understood to imply the inclusion of stated elements but not the exclusion of any other elements.

FIG. 1 is a block diagram illustrating the configuration of a display device according to an exemplary embodiment of the present invention.

As illustrated in FIG. 1, a display device includes a display unit 10, a scan driver 20, a data driver 30, a timing controller 40, a power controller 50, and a compensation control signal unit 60.

The display unit 10 includes a plurality of pixels coupled to (e.g., connected with) corresponding scan lines of a plurality of scan lines S1-Sn (not shown) and to corresponding data lines of a plurality of data lines D1-Dm (not shown). The pixels are each coupled to (e.g., connected with) a corresponding first voltage line of a plurality of first voltage lines to receive a first power source voltage ELVDD and to a corresponding second voltage line of a plurality of second voltage lines to receive a second power source voltage ELVSS.

Corresponding scan signals of a plurality of scan signals S[1]-S[n] are transmitted through the scan lines S1-Sn, and corresponding data signals of a plurality of data signals data[1]-data[m] are transmitted through the data lines D1-Dm.

The data signals data[1]-data[m] are generated from image data signals DATA2 using (e.g., through) image processing, such as compensation of luminance, of external image signals DATA1 and are transmitted to each of the pixels, respectively, in the display unit 10.

The scan signals S[1]-S[n] are signals that respectively activate a plurality of pixels in the display unit 10 such that the pixels can display images according to the corresponding data signals data[1]-data[m].

The pixels are activated (e.g., display images) according to the corresponding scan signals and emit light in response to driving currents according to the corresponding data signals.

Further, the pixels are each connected to a corresponding first control line of a plurality of first control lines transmitting (e.g., configured to transmit) a first control signal GC. The first control signal GC is a control signal that may be involved with the process of resetting pixels (e.g., resetting whole pixels) and/or the process of compensating for the threshold voltage of driving transistors of pixels (e.g., whole pixels). In more detail, the first control signal GC can control a reference voltage (e.g., predetermined reference voltage) that is applied to the gate electrodes of the driving transistors through the data lines of the pixels in the display unit 10. Further, the first control signal GC can compensate for the threshold voltage of the driving transistors to improve (e.g., reduce) non-uniformity of the luminance due to differences in the threshold voltage of the driving transistors of the pixels in the display unit 10.

Further, the pixels are each connected to a corresponding second control line of a plurality of second control lines transmitting (e.g., configured to transmit) a second control signal GE. The second control signal GE can prevent a backward voltage from being applied to the organic light emitting diodes OLEDs during the process of resetting each of the pixels. More particularly, the second control signal GE can block (e.g., completely block) the current paths to the organic light emitting diodes OLEDs, such that the driving operation of the pixels, including resetting, compensating of a threshold voltage, and programming of data can be performed without a backward voltage being applied to the organic light emitting diodes OLEDs.

Further, the second control signal GE can control light emitting duty by adjusting (e.g., controlling) the light emission periods and the non-light emission periods of the pixels.

According to another exemplary embodiment of the present invention, each pixel may be additionally coupled to (e.g., connected with) a corresponding third control line of a plurality of third control lines transmitting (e.g., configured to transmit) a third control signal GW. In a driving-type display device that simultaneously programs data and emits light and in accordance with another exemplary embodiment of the present invention, the third control signal GW can control the process of transmitting data in (e.g., within) each of the pixels in the display unit. In more detail, it is possible to control the transmission of the voltages according to the data signals programmed in the previous frames of the pixels to the gate electrode of each of the driving transistors of each of the pixels. However, the third control signal GW may not be necessary in display devices that are driven in different ways or in this or other embodiments, in which case it can be removed.

The first control signal GC, the second control signal GE, the third control signal GW, which may be added depending on exemplary embodiments, adjustment of the level of the driving power source voltages ELVDD and ELVSS, and the process of transmitting the scan signal and the data signal are described below in more detail with reference to the diagrams illustrating the circuit structure of a pixel and the driving method or process.

The scan driver 20 generates and transmits a plurality of scan signals S[1]-S[n] through a plurality of scan lines connected to the display unit 10 in response to (e.g., according to) a scan control signal CONT2. The scan control signal CONT2 allows (e.g., controls) scan signals corresponding to the pixel lines to be sequentially transmitted to the pixels in the display unit 10 during the scan period.

The data driver 30 transmits an image data signal DATA2, which corresponds to an external image signal DATA1, to the pixels in the display unit 10 through a plurality of data lines in response to (e.g., according to) the data control signal CONT1. The data control signal CONT1 allows data signals data[1]-data[m], which correspond to a plurality of pixels activated by scan signals S[1]-S[n] for the scan period of one frame, of the image data signals DATA2 to be transmitted. Therefore, the pixels store data voltages according to the corresponding data signals data[1]-data[m], thereby programming (e.g., storing) data.

Further, the data driver 30, according to another exemplary embodiment of the present invention, can transmit a reference voltage (e.g., predetermined reference voltage) simultaneously to a plurality of pixels through the data lines before transmitting data voltages according to the image data signals under the control of (e.g., according to) the data control signal CONT1.

The reference voltage (e.g., predetermined reference voltage) may be set as a reset voltage depending on exemplary embodiments of the driving method of a display device.

In more detail, the data driver 30 can transmit the reference voltage (e.g., predetermined reference voltage) as a reset voltage during the reset period when the voltages previously programmed in the driving transistor of the pixels are reset. Although the value (e.g., voltage value) of the reference voltage is not specifically limited, it may be set to be a value within a range of the data voltages according to the data signals.

The power controller 50 supplies (e.g., provides or is configured to supply) a first power source voltage ELVDD and a second power source voltage ELVSS for driving the pixels, after adjusting the levels (e.g., voltage levels) of the power source voltages, through the first voltage lines and the second voltage lines, respectively, connected to the pixels in the display unit in response to (e.g., according to) the power control signal CONT3.

According to the driving method of the present invention, the first power source voltage ELVDD is controlled to be a high-level voltage (e.g., predetermined high-level voltage) different from a low-level voltage (e.g., predetermined low-level voltage) and then applied according to (e.g., during) the driving periods. Further, according to the driving method of the present invention, the second power source voltage ELVSS is set as a low-level voltage (e.g., predetermined low-level voltage) and then applied as a fixed voltage (e.g., fixed voltage value).

The power control signal CONT3 controls (e.g., is configured to control) when (e.g., allows) the power controller 50 transmits the first power source voltage ELVDD and the second power source voltage ELVSS to all of the pixels, after adjusting the levels (e.g., voltage levels) of the power source voltages ELVDD and ELVSS to be different for each driving process. That is, the power controller 50 determines the levels of the first power source voltage ELVDD and the second power source voltage ELVSS and then supplies the power source voltages to corresponding voltage lines in response to (e.g., according to) the power control signal CONT3 during the process of resetting the gate electrode voltages of the driving transistors, the process of compensating for the threshold voltages of the driving transistors, the process of scanning and programming data, and the process of emitting light, which each occur during the driving process according to an exemplary embodiment of the present invention.

The Compensation control signal unit 60 generates (e.g., is configured to generate) and transmits a first control signal GC and a second control signal GE to the pixels in the display unit according to a compensation control signal CONT4. Further, it is possible to generate and transmit a third control signal GW using the driving method according to another exemplary embodiment.

In more detail, the compensation control signal CONT4 may include a first compensation signal for determining the pulse voltage level of the first control signal GC, a second compensation signal for determining the pulse voltage level of the second control signal GE, and a third compensation control signal for determining the pulse voltage level of the third control signal GW during the driving period according to the driving method of the present invention.

The timing controller 40 generates (e.g., is configured to generate) an image data signal DATA2 corresponding to an external image signal DATA1 and controls the functions and operations of the components of the display device. In more detail, the timing controller 40 generates the image data signal DATA2 by processing the external image signal DATA1 by dividing each frame in response to a vertical synchronization signal Vsync and dividing each pixel line (scan line) in response to a horizontal synchronization signal Hsync. The image data signal DATA2 is transmitted together with (e.g., concurrently with) the data control signal CONT1 to the data driver 30.

Synchronization signals for the image signal DATA1, the vertical synchronization signal Vsync, the horizontal synchronization signal Hsync, and a main clock signal MCLK are processed (e.g., generated) from an external input signal.

The external image signal DATA1 is divided according to each frame and processed into (e.g., as) an image signal corresponding to each frame. In some cases, the external image signal DATA1 may include image signals corresponding to a left-eye view point and a right-eye view point for displaying (e.g., implementing) a 3-dimensional (3-D) stereoscopic image. In this exemplary embodiment, the timing controller 40 can generate a stereoscopic image data signal by generating a first view point (left eye or right eye) image data signal and a second view point (right eye or left eye) image data signal from an external input signal according to vertical synchronization and horizontal synchronization signals.

When the processes of resetting, compensating, scanning, programming data, and emitting light are included in one frame using (e.g., by) the driving method according to an exemplary embodiment of the present invention, the processes of scanning and emitting light occupy most of one frame (60 Hz), such that the vertical synchronization signal Vsync can be transmitted once every scanning and light emitting period.

When the display unit simultaneously programs data and emits light according to another exemplary embodiment of the driving method of the present invention, the entire scanning process may be performed for a time close to one frame (60 Hz) as a data programming time in the display unit. Therefore, the vertical synchronization signal Vsync can be transmitted once every scanning process time, close to the time of one entire frame.

Further, the horizontal synchronization signal Hsync can be set at a frequency to activate each pixel line in the display unit in one frame period (e.g., as a frequency in accordance with the period where the process of scanning is performed in one frame period).

The main clock signal MCLK may be a clock signal having a basic frequency and included in the external input signal or may be one of the clock signals generated by appropriate preprocessing.

Figure 2:
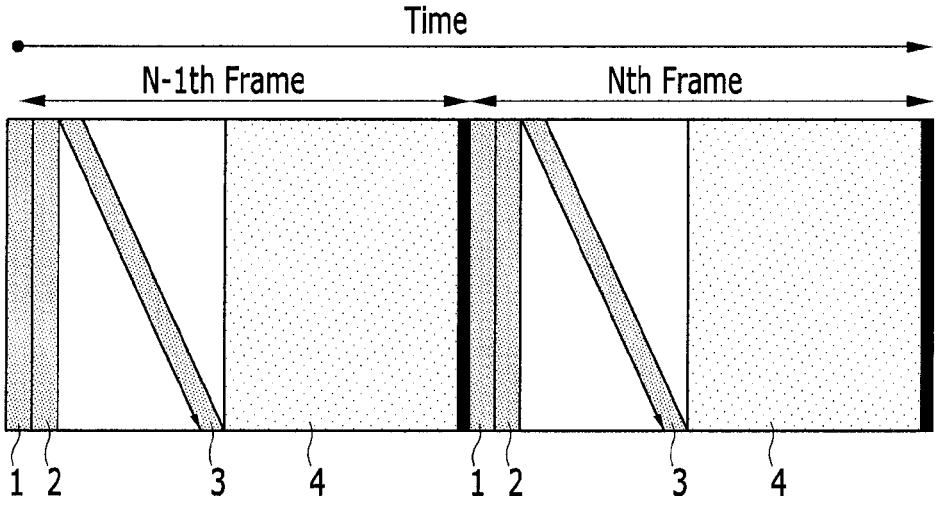
FIG. 2 is a diagram illustrating a method of driving a display device according to an exemplary embodiment of the present invention.

FIG. 2 is a diagram illustrating a method of driving a display device according to an exemplary embodiment of the present invention.

As illustrated in FIG. 2, the period of one frame includes a reset period 1, a compensation period 2, a scan period 3, and a light emission period 4. Although not shown in FIG. 2, one frame may further include a light emitting-off period after the light emission period 4 or an initializing period before or after the reset period 1.

In more detail, the reset period 1 is a period of resetting the driving voltages of the organic light emitting diode OLED in each pixel, that is, a period of resetting the gate electrode voltages of the driving transistors of each pixel.

The compensation period 2 is a period of compensating for the threshold voltage of the driving transistor of each pixel. Because the driving transistor of each pixel in the display unit may have a different threshold voltage due to, for instance, factors in the manufacturing process of a panel or the material properties, it is difficult to display an exact (e.g., predetermined) luminance of the pixels due to the differences in the threshold voltages. Therefore, the threshold voltages of the driving transistors of all of the pixels are generally compensated to improve (e.g., reduce) non-uniformity of luminance due to the differences in the threshold voltages.

The scan period 3 is a period where scan signals are transmitted to the plurality of pixels in the display unit 10. The pixels which receive the scan signals are activated and corresponding data signals are transmitted and programmed, such that the scan period 3 is also a data writing (programming or storing) period.

The light emission period 4 is a period when the organic light emitting diode OLED of the pixels displays an image by emitting light according to the data voltages of the data signals supplied to the pixels during (e.g., in) the scan period 3. As illustrated in FIG. 2, scan signals are sequentially transmitted to all of the pixels in the display unit and data is programmed, but the pixels simultaneously emit light for the light emission period 4 according to the driving current according to the programmed data signals.

Similarly, as shown in FIG. 2, the process of resetting and the process of compensating a threshold voltage are generally and simultaneously performed in all of the pixels in the display unit during the reset period 1 and the compensation period 2, respectively.

Figure 3:
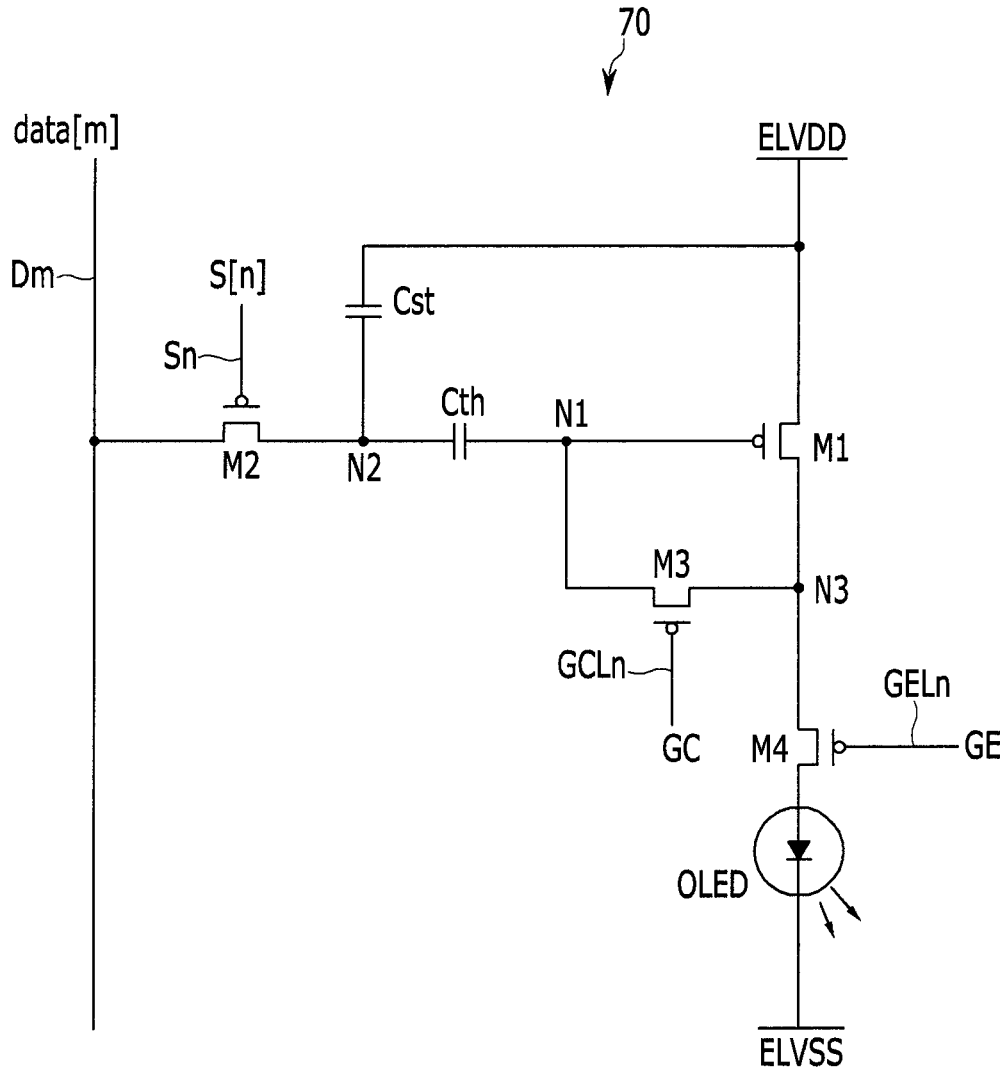
FIG. 3 is a circuit diagram illustrating a structure according to an exemplary embodiment of a pixel operating using the driving method illustrated in FIG. 2.

FIG. 3 is a circuit diagram illustrating a structure according to an exemplary embodiment of a pixel operating using (e.g., in) the driving method illustrated in FIG. 2. FIG. 3 illustrates the structure of a pixel that is driven in a simultaneous light emitting display where, as illustrated in FIG. 2, all pixels in the display unit 10 are sequentially activated and simultaneously emit light after data signals are transmitted and programmed.

The pixel of FIG. 3 is one of the pixels in the display unit 10 of the display device shown in FIG. 1 and is an example of a pixel of the plurality of pixels corresponding to the m-th pixel row in the n-th pixel line.

Therefore, the pixel of FIG. 3 is formed at the intersection (e.g., crossing) of the n-th scan line Sn connected to the n-th pixel line and the m-th data line Dm connected to the m-th pixel row and is connected to the n-th scan line Sn and the m-th data line Dm. Further, it is connected to a control line transmitting a control signal controlling (e.g., configured to control) the operation of a pixel, for example, it is connected to a first control line GCLn and a second control line GELn corresponding to the pixel 70.

Further, the pixel 70 has a structure in which a voltage line is connected to both ends of a driving transistor M1 and an organic light emitting diode OLED connected in series.

In more detail, a first power source voltage ELVDD is supplied through (e.g., to) the voltage line connected with the source electrode of the driving transistor M1 and a second power source voltage ELVSS is supplied through (e.g., to) the voltage line connected with the cathode of the organic light emitting diode OLED.

The pixel shown in FIG. 3 includes four transistors M1, M2, M3, and M4, a storage capacitor Cst, a compensation capacitor Cth, and an organic light emitting diode OLED.

The channels of the four transistors M1, M2, M3, and M4 shown in FIG. 3 are P-channels. However, the present invention is not limited thereto and the channels of the transistors depend on signal levels inputted at (e.g., applied to) the gate electrodes of the transistors and the operational statuses of the transistors according to the signal levels.

The driving transistor M1 includes a source electrode connected to the first power source voltage ELVDD, a drain electrode connected to an anode of the organic light emitting diode OLED, and a gate electrode connected to a first node N1.

A switching transistor M2 includes a source electrode connected to the m-th data line Dm to receive (e.g., configured to receive) a voltage (e.g., predetermined voltage) through the data line, a drain electrode connected to a second node N2, and a gate electrode connected to the n-th scan line Sn to receive (e.g., configured to receive) the n-th scan signal S[n].

A compensation transistor M3 includes two electrodes connected to the gate electrode and the drain electrode of the driving transistor M1, respectively, and a gate electrode connected to the first control line GCLn where the first control signal GC is inputted. The compensation transistor M3 connects (e.g., diode-connects) the driving transistor M1 during the compensation period according to the driving method shown in FIG. 2.

A light emission control transistor M4 includes a source electrode connected to a third node N3, which is connected with one of the two electrodes of the compensation transistor M3, a drain electrode connected to an anode of the organic light emitting diode OLED, and a gate electrode connected to the second control line GELn where the second control signal GE is inputted. When turned on during the light emission period 4, the light emission control transistor M4 allows a driving current according to a data signal transmitted from the driving transistor M1 to flow to the anode of the organic light emitting diode OLED according to the driving method shown in FIG. 2.

The storage capacitor Cst includes an electrode connected to the second node N2 and another electrode connected to the voltage line supplying the first power source voltage ELVDD. The storage capacitor Cst stores a voltage according to a voltage differential between both electrodes. Therefore, it can store a voltage (e.g., a voltage value) according to the amount of change of voltages applied to the second node N2 during the processes according to the driving method of the present invention.

A compensation capacitor Cth includes an electrode connected to the first node N1, which is connected to the gate electrode of the driving transistor M1, and another electrode connected to the second node N2, which is connected to an electrode of the storage capacitor Cst and the drain electrode of the switching transistor M2.

Hereinafter, the operations of the pixel 70 during the periods of the driving method (driving method shown in FIG. 2) according to an exemplary embodiment of the present invention are described with reference to FIG. 4.

Figure 4:
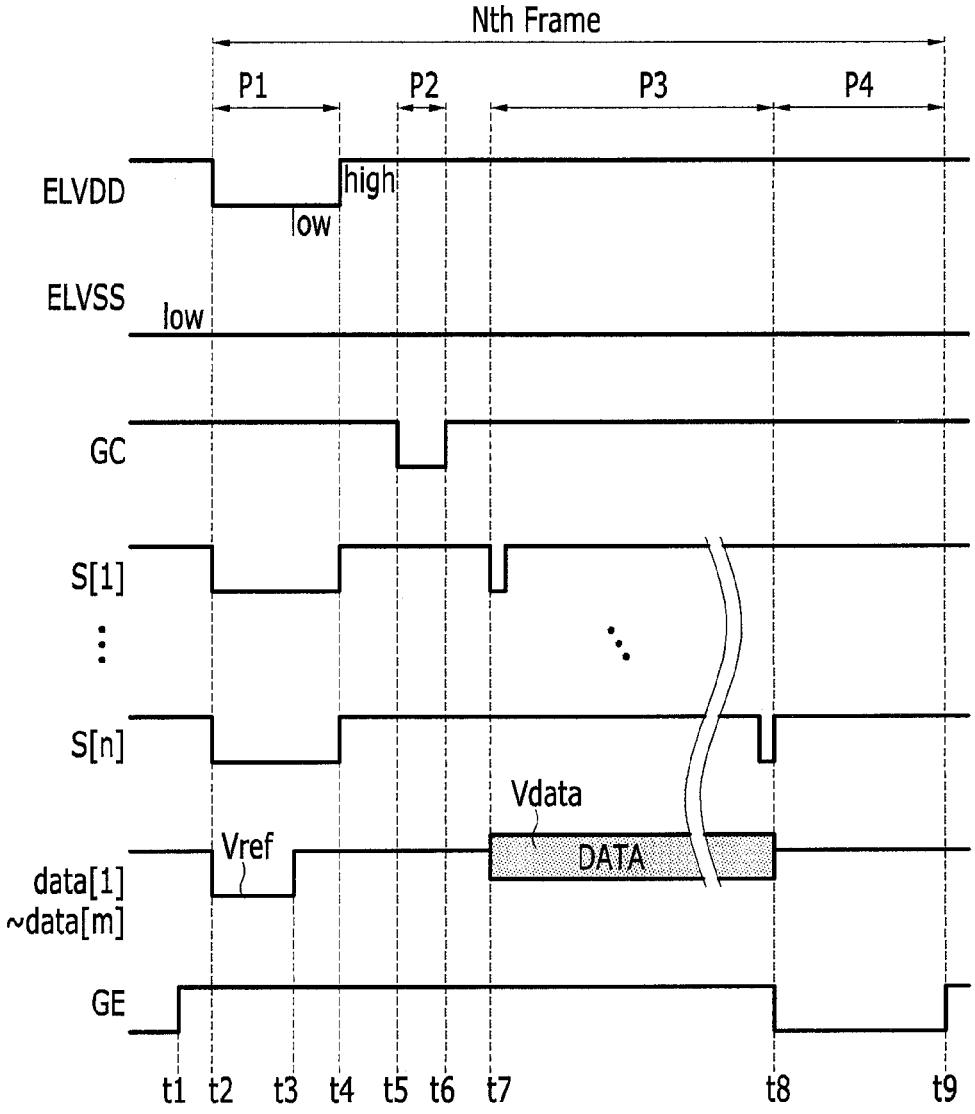
FIG. 4 is a diagram illustrating driving waveforms of the pixel illustrated in FIG. 3.

FIG. 4 shows driving waveforms for the N-th frame Nth Frame of a plurality of frames.

As shown in FIG. 4, the N-th frame Nth Frame includes a reset period P1, a compensation period P2, a scan period P3, and a light emission period P4. Driving power source voltages ELVDD and ELVSS, scan signals S[1]-S[n], a first control signal GC, a second control signal GE, and data signals data [1]-data[m] are changed during (e.g., in or according to) the periods. However, the second power source voltage ELVSS of the driving power source voltages does not change (e.g., the voltage of ELVSS does not change) in the N-th frame Nth Frame and remains a fixed low-level voltage Low (e.g., a predetermined, fixed low-level voltage).

Referring to FIG. 4, the second power source voltage ELVSS applied to the cathode of the organic light emitting diode OLED is supplied (e.g., fixedly supplied) without swing (e.g., variance), such that it does not influence the operations according to (e.g., controlled by) other signals. Because the parasitic capacitance of the pixel is increased due to the large area of the organic light emitting diode, when the second power source voltage ELVSS applied to the cathode of the organic light emitting diode OLED swings, a coupling effect involving (e.g., of) the organic light emitting diode OLED may influence the operation of control signals of this or other pixels with varying (e.g., different) amounts of change in voltage. However, according to an exemplary embodiment of the present invention, because the second power source voltage ELVSS does not swing, the effects due to the coupling effect involving the organic light emitting diode OLED can be prevented or lowered. Therefore issues or artifacts appearing on a screen, such as dark portions, due to the coupling effect are avoided or lowered.

The operation of a pixel for each period according to the driving method of an exemplary embodiment of the present invention is hereinafter described.

First, the second control signal GE rises from a low level to a high level at the point of time t1 when the light emission period of the previous frame N−1th Frame ends. The N-th frame Nth Frame is a corresponding frame and starts at the point of time t2. The reset period P1 is the period (e.g., section) between the point of time t2 and the point of time t4.

The scan signals S[1]-S[n], respectively corresponding to all of the pixels in the display unit, are all simultaneously changed from high levels to low levels and then transmitted at the point of time t2 in the reset period P1. Further, data signals data[1]-data[m] are all set as reference voltage Vref and are transmitted through the corresponding data lines connected to all of the pixels. Although the voltage (e.g., voltage value) of the reference voltage Vref is not specifically limited, it may be within a range of the data voltages according to image data signals.

The scan signal S[1]-S[n] are all simultaneously changed again from the low level to the high level at the point of time t4. The reference voltage Vref may be changed to a high-level voltage (e.g., predetermined high-level voltage) and transmitted at the point of time t4, but as shown in FIG. 4, it may be changed to a high level at the point of time t3 in the reset time P1.

Accordingly, the switching transistor M2 is turned on at the point of time t2 and transmits the reference voltage (e.g., predetermined reference voltage) Vref through the data line Dm, connected to the source electrode of the switching transistor M2, to the second node N2 connected to the drain electrode of the switching transistor M2. During this process (e.g., the reset process), the switching transistors of all of the pixels in the display unit are simultaneously turned on in response to (e.g., according to) the plurality of scan signals S[1]-S[n] while the same reference voltage Vref is applied to each second node N2.

The reference voltage Vref may be set to be a voltage lower (e.g., at a level lower) than the range of the data voltages, as described above, and the reference voltage Vref may be kept (e.g., maintained) at the low level to (e.g., until) the point of time t3 and then transmitted. However, the present invention is not limited thereto and a low-level reference voltage Vref may be supplied at the point of time t4 or at any point of time during the reset period P1.

The reference voltage Vref applied to the second node N2 is stored and maintained by the storage capacitor Cst.

The reference voltage Vref applied to the second node N2 changes the voltage at the first node N1 to a low level due to coupling with the compensation capacitor Cth. Therefore, the voltage at the first node N1 decreases enough to turn on the driving transistor M1. Accordingly, as the driving transistor M1 is turned on, the first power source voltage ELVDD, a driving voltage, is applied at a low level to the drain electrode of the driving transistor M1, that is, to the third node N3. Therefore, the voltage at the third node N3 drops and is reset.

Because the second control signal GE is maintained at a high level and inputted during the reset period P1, the light emission control transistor M4 is turned off. Therefore, the current at (e.g., applied to) the drain electrode of the driving transistor M1 does not flow. Because a current does not flow to the organic light emitting diode OLED from the driving transistor M1, the second power source voltage ELVSS that is applied to the anode of the organic light emitting diode OLED at a low level does not apply a backward voltage to the organic light emitting diode OLED. As described above, turning off the light emission control transistor M4 in response to (e.g., according to) the second control signal GE during the reset period P1 without applying a backward voltage to the organic light emitting diode OLED makes it possible to block the current path to the cathode of the organic light emitting diode, such that the pixel can perform the operation (e.g., the reset operation or process) without interference.

Next, the period (e.g., section) between the point of time t5 and the point of time t6 is the compensation period P2. The first power source voltage ELVDD changed to a high level at the point of time t4 and maintains the high level, and the second power source voltage ELVSS is applied fixedly at a low level.

The scan signals S[1]-S[n] simultaneously change to high levels at the point of time t4. Accordingly, the switching transistors M2 in all of the pixels are turned off during the compensation period P2.

The first control signal GC changes from a high level to a low level at the point of time t5 and rises again to a high level at the point of time t6. Therefore, the compensation transistor M3 is turned on in response to (e.g., according to) the first control signal GC. Accordingly, the gate electrode and the drain electrode of the driving transistor M1 are connected (i.e., diode-connected), such that the voltage at the first node N1 and the voltage at the third node N3 become the same (e.g., equalize). Because the first power source voltage ELVDD is transmitted to the third node N3 through the driving transistor M1 during the compensation period P2, the voltages applied to the third node N3 and the first node N1 become the sum of the first power source voltage ELVDD at the high level and the threshold voltage of the driving transistor M1 (e.g., ELVDD+Vth).

Because the second control signal GE is maintained at a high level during the compensation period P2, the light emission control transistor M4 remains (e.g., keeps) turned off. Therefore, the supply terminal of the first power source voltage ELVDD is electrically disconnected from (e.g., unaffected by) the parasitic capacitance of the organic light emitting diode OLED, such that compensation for the threshold voltage of the driving transistor M1 is not (e.g., never) influenced by the size of the parasitic capacitance of the organic light emitting diode OLED.

Next, the first scan signal S[1] that is transmitted to the first pixel line through (e.g., in) the scan lines is changed from a high level to a low level and transmitted to the pixels in the corresponding first pixel line at the point of time t7. Further, while the scan signals are sequentially transmitted to the pixel lines, respectively, the n-th scan signal S[n] corresponding to the n-th pixel line, which is the last pixel line, drops to a low level at a point of time before t8 and then rises to a high level at the point of time t8.

Therefore, the scan signals S[1]-S[n] are sequentially transmitted to all the pixels from the point of time t7 to the point of time t8 and sequentially turn on the switching transistors M2 in each pixel. Accordingly, data voltages data[1]- data[m] according to corresponding image data signals are transmitted to the pixels through corresponding data lines connected to the source electrodes of the switching transistors M2 of the pixels. The data voltages data[1]-data[m] are transmitted to the second node N2 and kept (e.g., stored) by the storage capacitor Cst in each pixel.

The voltage applied to the first node N1 reflects the amount of change due to the data voltage applied to the second node N2, due to a coupling effect of the compensation capacitor Cth connected to the second node N2. Although the amount of change depends, in part, on the ratio between the capacitance of the compensation capacitor Cth and the parasitic capacitance of the driving transistor M1, the parasitic capacitance of the driving transistor M1 is negligible (e.g., small), therefore the ratio of the capacitances can be neglected.

Because the first control signal GC and the second control signal GE are both applied at high levels during the scan period P3, the compensation transistor M3 and the light emission control transistor M4 of each pixel remain (e.g., keep) turned off. Therefore, the data voltages according to the image data signals can be stably applied to the gate electrodes of the driving transistor M1 of each pixel without being influenced by the parasitic capacitance (e.g., the size of the parasitic capacitance) of the organic light emitting diode OLED.

Light is simultaneously emitted according to the amount of driving current of the data voltages according to the data signals programmed in all of the pixels in the display unit, from the point of time t8, when the scan signal S[n] corresponding to the n-th pixel line, which is the last pixel line, changes from a low level to a high level. That is, the period from the point of time t8 to the point of time t9 is the light emission period P4, when all of the pixels in the display unit simultaneously display images (e.g., emit light). However, the present invention is not limited to the exemplary embodiment and the light emission period P4 may start after the n-th scan signal S[n] is transmitted at a low level and then a time (e.g., a predetermined time) passes.

The first power source voltage ELVDD and the second power source voltage ELVSS remains (e.g., keep transmitting) at a high level and a low level, respectively, during the light emission period P4. Further, the first control signal GC remains at a high level, but the second control signal GE is applied at a low level during the light emission period P4.

Therefore, the light emission control transistors M4 of all of the pixels are turned on and the driving currents according to the data voltages according to the data signals applied to the gate electrodes of the driving transistors flow to the organic light emitting diodes OLEDs. Accordingly, the organic light emitting diodes OLEDs of all of the pixels in the display unit simultaneously emit light (e.g., display an image), corresponding to the amount of driving currents.

The image displayed by simultaneously lighting all of the pixels in the display panel is uniformly displayed during the light emission period P4 by the driving currents flowing in response to (e.g., according to) the image data signals, without being influenced by the threshold voltages Vth of the driving transistors and the first power source voltage ELVDD.

Although a plurality of image data signals are described under the assumption that they are image data signals at one view point corresponding to the current frame, such as the exemplary embodiment shown in FIGS. 3 and 4, the present invention is not limited to this exemplary embodiment and image data at a plurality of view points for displaying a stereoscopic image may be included. That is, the image data signals may be left-eye image data signals for the first view point or may be right-eye image data signals for the second view point. Even though the image data signals for implementing (e.g., displaying) a stereoscopic image are signals at different view points, they are transmitted through data drivers and driven in pixels using (e.g., in) a substantially similar method.

Figure 5:
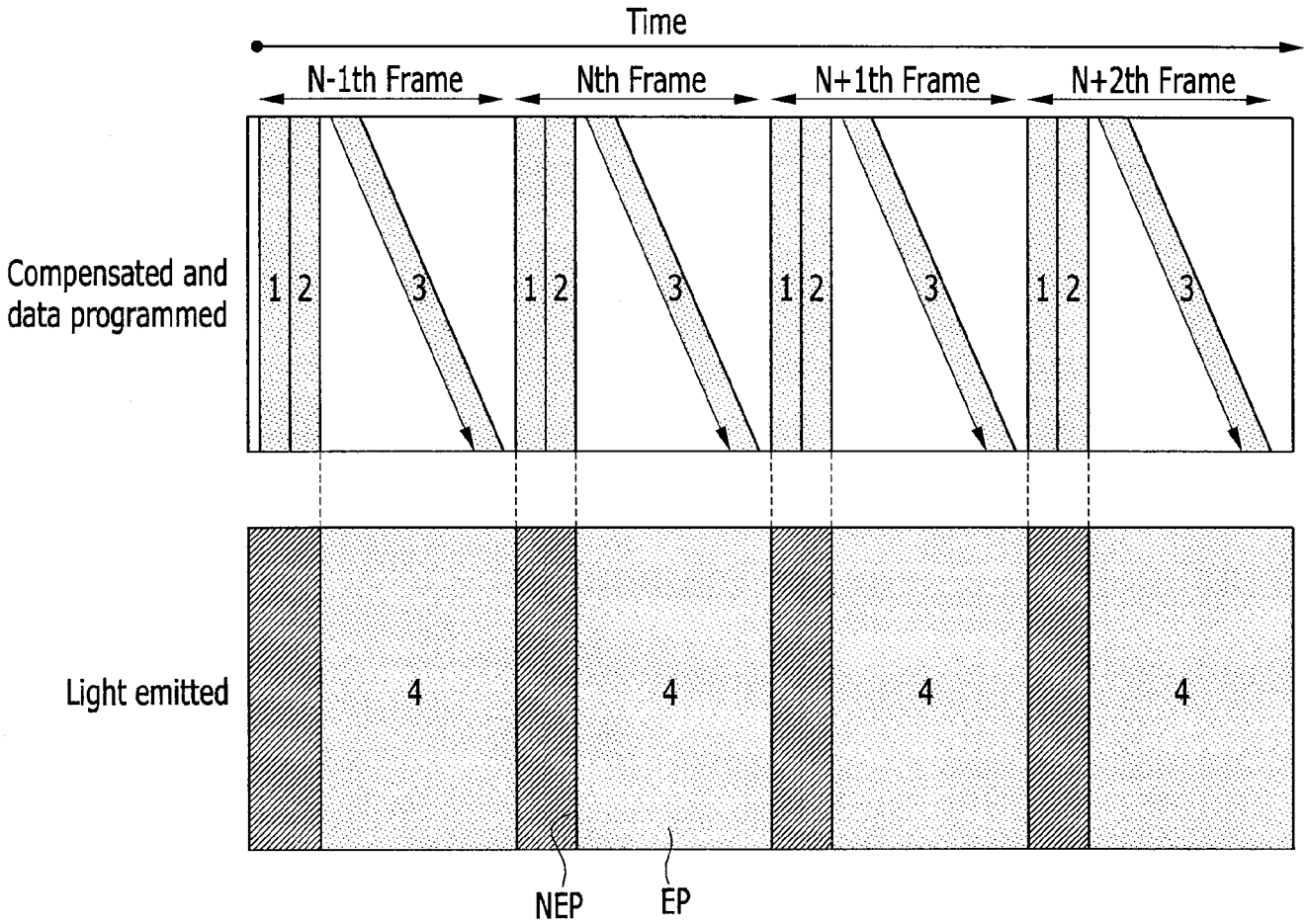
FIG. 5 is a diagram illustrating a method of driving a display device according to another exemplary embodiment of the present invention.

FIG. 5 is a diagram illustrating a method of driving a display device according to another exemplary embodiment of the present invention.

According to the driving method of FIG. 5, the reset period 1, the compensation period 2, the scan period 3, and a light emission period 4 are included in one frame, but the scan period 3 and the light emission period 4 overlap in time (e.g., overlap in terms of time).

The pixels emit light according to the data programmed in the scan period 3 of the previous frame during the light emission period 4 of the current frame, and the pixels emit light during the light emission period of the next frame in accordance with the data programmed during (e.g., in) the scan period 3 of the current frame.

Assuming that one frame is divided into a light emission period EP when an image is displayed and a non-light emission period NEP when an image is not displayed, the non-light emission period NEP corresponds to the reset period 1 and the compensation period 2. Therefore, almost the entire period of one frame can be the light emission period, such that it is possible to allocate (e.g., secure) time for scanning and programming data without requiring (e.g., against) high-speed driving, and accordingly, it is possible to sufficiently display an image.

In more detail, the scan period 3 and the light emission period 4 of the N-th frame are included in the light emission period EP of the N-th frame Nth Frame. Therefore, the data that is programmed (e.g., stored) in the pixels during the scan period 3 of the light emission period EP of the N-th frame Nth Frame is the data corresponding to the N-th frame and the pixels emit light according to the data of the N−1−th frame N−1th Frame which was programmed during the scan period 3 of the N−1-th frame during the light emission period 4 of the light emission period EP.

Further, the pixels simultaneously emit light during the light emission period 4 of the N+1-th frame according to the data of the N-th frame programmed (e.g., stored) in the pixels during the scan period 3 of the light emission period EP.

A pixel structure for programming data of the current frame into pixels during the scan period 3 and for allowing the pixels to emit light in accordance with the data of the previous frame during the light emission period 4, which overlaps with the scan period 3, is described with reference to FIG. 6.

Figure 6:
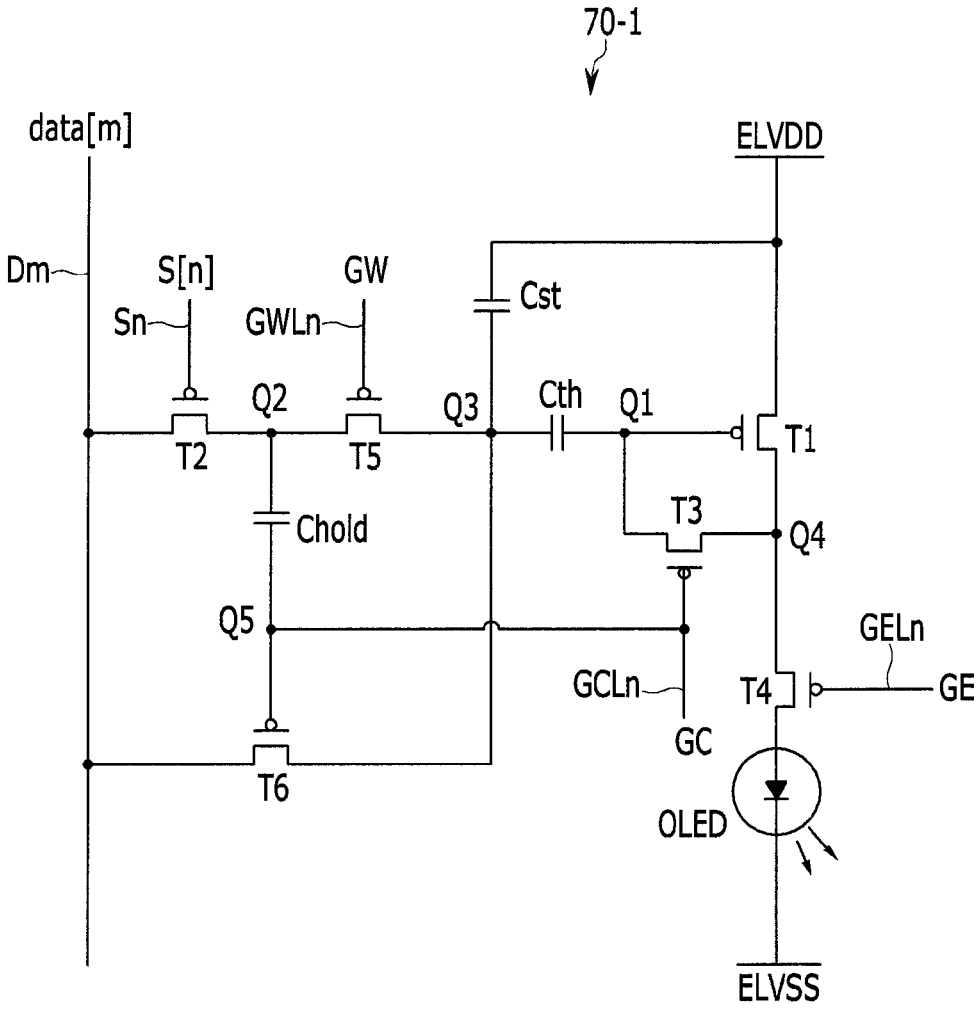
FIG. 6 is a circuit diagram illustrating a structure according to another exemplary embodiment of a pixel operating using the driving method illustrated in FIG. 5.

FIG. 6 is a circuit diagram of a pixel included in the display unit 10 of the display device (shown in FIG. 1) according to an exemplary embodiment of the present invention.

Figure 7:
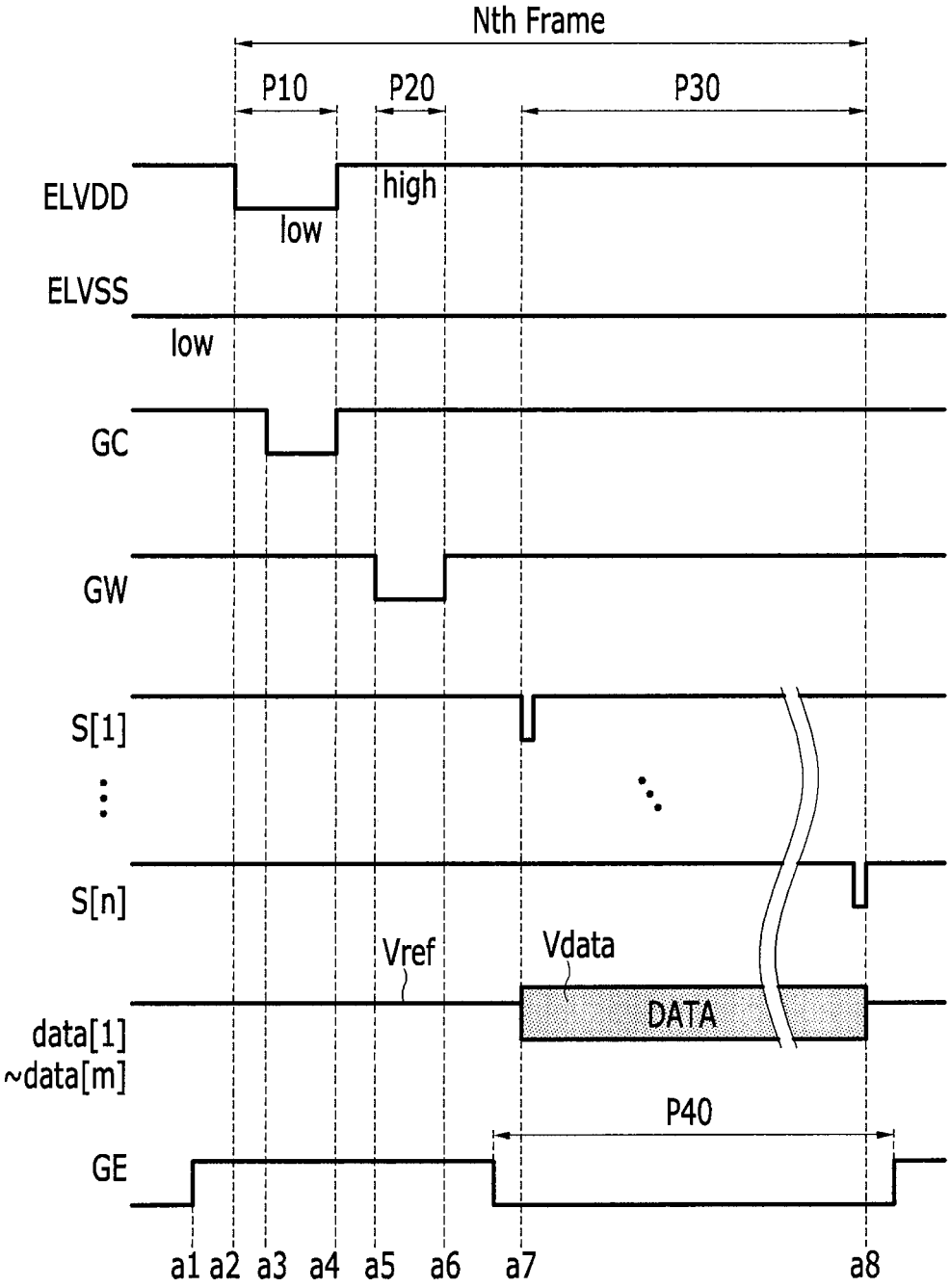
FIG. 7 is a diagram illustrating driving waveforms of the pixel illustrated in FIG. 6.

The pixel shown in FIG. 6 is a pixel disposed (e.g., located or arranged) in the m-th pixel row of the n-th pixel line, but it has a circuit structure according to another exemplary embodiment, different from the pixel circuit of FIG. 3. Therefore, the pixel 70 of FIG. 7 is referred to as a first pixel and the pixel 70-1 shown in FIG. 6 is referred to as a second pixel hereafter.

The second pixel 70-1 of FIG. 6 has a structure, different from the first pixel, which is activated and programmed with data during the scan period 3 and emits light using (e.g., with) an organic light emitting diode OLED according to the data programmed during the previous frame.

The second pixel 70-1 of FIG. 6 includes six transistors T1 to T6, a storage capacitor Cst, a compensation capacitor Cth, a holding capacitor Chold, and an organic light emitting diode OLED.

However, the circuit structure of a pixel is not limited to that shown in FIG. 6 and it may be designed according to various, different structures including a light emission control transistor T4 controlling (e.g., selectively controlling or configured to control) voltage supplied to an anode of the organic light emitting diode OLED thereby controlling light emission, and designed to be able to emit light using an organic light emitting diode OLED simultaneously with data programming during a scan period.

The channels of the six transistors T1 to T6 shown in FIG. 6 are P-channels. However, the present invention is not limited thereto and the channels of the transistors depend on signal levels inputted to the gate electrodes of the transistors and the operational statuses of the transistors according to the signal levels.

The first transistor T1, a driving transistor, includes a source electrode connected to a first power source voltage ELVDD, a drain electrode connected to an anode of the organic light emitting diode OLED, and a gate electrode connected to a first node Q1. The first transistor T1 allows an image to be displayed by passing the amount of driving current according to a data voltage according to an image data signal to the organic light emitting diode OLED.

The second transistor T2, a switching transistor, includes a source electrode connected to a corresponding data line Dm, a drain electrode connected to a second node Q2, and a gate electrode connected to a corresponding scan line Sn. The second transistor T2 transmits (e.g., is configured to transmit) a voltage (e.g., predetermined voltage) data[m] through a data line in response to a corresponding scan signal S[n], applied to the gate electrode, to the second node Q2. The voltage data[m] applied through the data line may be a reset voltage corresponding to a reference voltage (e.g., predetermined reference voltage) of the driving process or may be a data voltage according to a corresponding data signal of a plurality of image data signals.

The third transistor T3, a threshold voltage compensation transistor, includes two electrodes respectively connected to the gate electrode and the drain electrode of the driving transistor T1, and a gate electrode connected to a first control line GCLn. The two electrodes of the third transistor T3 include one electrode connected to the first node Q1 and the other electrode connected to a fourth node Q4.

The third transistor T3 connects the gate electrode and the drain electrode of the driving transistor T1 when it is turned on (e.g., configured to be turned on) in response to a first control signal GC being applied to the gate electrode. Accordingly, the voltages at the first node Q1 and the fourth node Q4 are the same (e.g., equal). That is, the voltage transmitted to the fourth node Q4 is equally applied to the first node Q1 by electric conduction to the first node Q1.

The fourth transistor T4, a light emission control transistor, includes a source electrode connected to the fourth node Q4, a drain electrode connected to the anode of the organic light emitting diode OLED, and a gate electrode connected to a corresponding second control line GELn. The fourth transistor T4 allows (e.g., is configured to allow) the organic light emitting diode to display an image (e.g., emit light) when it is turned on in response to a second control signal GE being transmitted to the gate electrode, such that a driving current according to a data signal, which flows from the driving transistor T1, is transmitted to the organic light emitting diode OLED.

The fifth transistor T5, a transmission transistor, includes a source electrode connected to the second node Q2, a drain electrode connected to a third node Q3, and a gate electrode connected to a corresponding third control line GWLn. The fifth transistor T5 is turned on (e.g., configured to be turned on) in response to a third control signal GW being transmitted to the gate electrode through the third control line GWLn and then transmits the voltage at (e.g., present at) the second node Q2 to the third node Q3. The voltage received by the third node Q3 is stored and maintained by the storage capacitor Cst and the compensation capacitor Cth.

The sixth transistor T6, a holding transistor, includes a source electrode connected to a corresponding data line Dm, a drain electrode connected to a third node Q3, and a gate electrode connected to a corresponding first control line GCLn. The sixth transistor T6 transmits (e.g., is configured to transmit) a reference voltage (e.g., predetermined reference voltage) through the data line Dm to the third node Q3 when it is turned on in response to the first control signal GC being transmitted to the gate electrode.

The storage capacitor Cst includes an electrode connected to the third node Q3 and another electrode connected to the voltage line transmitting the first power source voltage ELVDD. The storage capacitor Cst stores and maintains a voltage (e.g., voltage value) according to the difference between the voltages applied to each electrode. Therefore, storage capacitor Cst is configured to maintain the voltage applied to the third node Q3 during the processes according to an exemplary embodiment of the present invention.

The compensation capacitor Cth includes a first electrode connected to the third node Q3 and a second electrode connected to the first node Q1. The compensation capacitor Cth stores and maintains a voltage according to the difference between the voltages applied to each electrode, and the voltage (e.g., voltage value) at the first node Q1 connected with the second electrode is changed due to a coupling effect according to the change in voltage at the third node Q3 connected with the first electrode.

The holding capacitor Chold includes one electrode connected to the second node Q2 and the other electrode connected to the gate electrode of the sixth transistor T6. In other words, the other electrode of the holding capacitor Chold is connected to a corresponding first control line GCLn. The holding capacitor Chold serves to store and maintain a voltage (e.g., voltage value) according to the difference between the voltages applied to each electrode. Therefore, it stores and maintains, for a period (e.g., a predetermined period), the data voltages according to the image data signals of the frames which are transmitted to the second node Q2 during the driving process according to an exemplary embodiment of the present invention.

Hereinafter, the operations of the pixel 70-1 in the periods of the driving method (driving method shown in FIG. 6) according to an exemplary embodiment of the present invention are described with reference to FIG. 7.

FIG. 7 shows driving waveforms for the N-th frame Nth Frame of a plurality of frames.

As shown in FIG. 7, the N-th frame Nth Frame includes a reset period P10, a compensation period P20, a scan period P30, and a light emission period P40. The scan period P30 and the light emission period P40 overlap (e.g., overlap in time), different from the driving methods of FIGS. 3 and 4. The period where the scan period P30 and the light emission period P40 overlap is not specifically limited, and the scan period P30 may be the same as the light emission period P40 or may be smaller or larger than the light emission period, according to adjustments of light emission duty.

Driving power source voltages ELVDD and ELVSS, scan signals S[1]-S[n], the first control signal GC, the second control signal GE, the third control signal GW, and the data signals data[1]-data[m] are changed according to the periods shown in FIG. 7. However, the second power source voltage ELVSS of the driving power source voltages does not change in voltage (e.g., voltage level) during the N-th frame Nth Frame and remains a fixed, low-level voltage Low (e.g., predetermined, fixed, low-level voltage).

Referring to FIG. 7, the second power source voltage ELVSS applied to the cathode of the organic light emitting diode OLED is fixedly supplied without swing, such that it does not influence the operations according to other signals. Because the parasitic capacitance of the pixel is increased due to the large area of the organic light emitting diode, the second power source voltage ELVSS may swing when applied to the cathode of the organic light emitting diode and a coupling effect of the organic light emitting diode OLED may influence the operation of control signals of this or other pixels with different amounts of change in voltage. However, according to an exemplary embodiment of the present invention, because the second power source voltage ELVSS does not swing, it is possible to prevent or reduce negative effects on a display, such as dark parts or dark spots, due to the coupling effect.

The operation of a pixel for each period according to the driving method of an exemplary embodiment of the present invention is hereinafter described.

First, the second control signal GE rises from a low level to a high level at the point of time a1, when the light emission period of the previous frame N−1th Frame ends. The N-th frame Nth Frame is a corresponding frame that starts (e.g., begins) at the point of time a2. The reset period P10 is the period between the point of time a2 and the point of time a4.

The first power source voltage ELVDD changes from a high level to a low level at the point of time a2 in the reset period P10. Accordingly, the voltage at the first node Q1 decreases to a low level though the storage capacitor Cst and the compensation capacitor Cth, such that the driving transistor T1 is turned on. As a result, the first power source voltage ELVDD is transmitted at the low level and the reset process is started.

At the point of time a3, the first control signal GC is changed into a pulse voltage at a low level from a high level and then applied. Accordingly, the third transistor T3 and the sixth transistor T6, of which the gate electrodes receive the first control signal GC, are simultaneously turned on. As the sixth transistor T6 is turned on, a voltage (e.g., predetermined voltage) is transmitted to the third node Q3 through a corresponding data line. The voltage data[m] transmitted through the data line is a reference voltage (e.g., predetermined reference voltage) Vref, as shown in FIG. 7. The reference voltage Vref is not specifically limited, but it may be at a level within the voltage range of the data signals.

Further, as the third transistor T3 is turned on, the reset process continues during the period from the point of time a3 to the point of time a4.

Due to the reset process started at the point of time a2 and continuing until the point of time a4, the low level voltage at the fourth node Q4 is transmitted to the first node Q1, such that the data voltage according to the data signal applied to the gate electrode of the driving transistor T1 during the previous frame is reset.

The second control signal GE remains at the high level during the period P10, and the fourth transistor T4, the light emission control transistor, is turned off, such that the path to the terminal of the second power source voltage ELVSS is blocked and the driving operation of the pixel may be accurately performed without applying a backward voltage to the organic light emitting diode OLED.

Next, the first power source voltage ELVDD and the pulse voltage of the first control signal GC both increase to high levels at the point of time a4. The threshold voltage of the driving transistor T1 is compensated for during the period between the point of time a4 and the point of time a5.

The third control signal GW drops to a low level from a high level at the point of time a5, maintains the low level, and then rises again to a high level at the point of time a6.

The period from the point of time a5 to the point of time p6 is a data transmission period or compensation period P20, in which the third control signal GW is transmitted at a low level, such that the fifth transistor T5 receives the third control signal GW through the gate electrode and is turned on. Therefore, the data voltage corresponding to the data signal of the previous frame N−1th Frame, previously transmitted to the second node Q2 and stored in the holding capacitor Chold, is transmitted to the third node Q3 through the fifth transistor T5.

The third control signal GW changes to a high level at the point of time a6, and the second control signal GE changes to a low level before the point of time a7 but after the fifth transistor T5 is turned off. The second control signal GE is transmitted and maintained at a low level before the point of time a7 and rises to a high level after the point of time a8.

The light emission period P40 is when the organic light emitting diodes OLEDs of all of the pixels display images by simultaneously emitting light, when the fourth transistor T4 receives the second control signal GE through the gate electrode and is turned on.

Accordingly, the organic light emitting diode OLED receives the amount of driving current according to the data voltage according to the image data signal of the previous frame transmitted to the gate electrode of the driving transistor T1, and thus, emits light. In more detail, the voltage at the first node Q1, that is, the voltage at the gate electrode of the driving transistor T1 is changed according to a coupling effect of the compensation transistor Cth corresponding to the amount of change in voltage according to the data signal applied to the third node Q3 during the data transmission period P20.

A voltage, up to and including as much as the sum of the first power source voltage ELVDD and the threshold voltage of the driving transistor T1 (e.g., ELVDD+Vth), is applied to the first node Q1 by the process of compensating for a threshold voltage, and a change in voltage, as much as the data voltage programmed in the previous frame, is transmitted to the third node Q3 during the period P20, such that the amount of change in voltage between the data voltage of the previous and current frames determines the amount of change in voltage at the first node Q1.

Therefore, the organic light emitting diodes OLEDs of the pixels display images by emitting light according to the amount of driving current according to the data signals programmed in the N−1-th frame, that is, the previous frame, during the light emission period P40 in the N-th frame, that is, a corresponding or current frame.

The pixel lines are sequentially scanned by a corresponding plurality of scan signals S[1]-S[n] simultaneously with the light emission period P40 or for a period shorter or longer than the light emission period P40.

That is, the first scan signal S[1] starts to be transmitted with a pulse voltage at a low level at the point of time a7 and scan signals are sequentially transmitted through the pixel lines thereafter, and the n-th scan signal S[n], the last scan signal, is transmitted at a low level and then rises to a high level at the point of time a8.

The period from the point of time a7 to the point of time a8 is the scan period P30, and during that period, the second transistors T2, the switching transistors, in the pixels are turned on in response to corresponding scan signals applied to the pixel lines, respectively. Therefore, the second transistor T2 receives a data voltage Vdata according to the image signal of the corresponding frame, that is, the N-th frame, through a corresponding data line. This is also a data programming period, in which the data voltage according to the data signal of the corresponding frame is transmitted to the second node Q2, and accordingly, the holding capacitor Chold stores and keeps the data DATA of the corresponding frame. The data voltage Vdata according to the data signal of the corresponding frame is stored in the holding capacitor Chold and the organic light emitting diodes OLEDs of all of the pixels simultaneously emit light in the light emission period of the next frame, thereby displaying images according to the data voltage Vdata.

Although a plurality of image data signals are described under the assumption that they are image data signals at one view point corresponding to the current frame, through the exemplary embodiment shown in FIGS. 6 and 7, the present invention is not limited to the exemplary embodiment, and image data at a plurality of view points for displaying a stereoscopic image may be included. That is, the image data signals may be left-eye image data signals for the first view point or may be right-eye image data signals for the second view point. Even though the image data signals for implementing a stereoscopic image are signals at different view points, they are transmitted through data drivers and driven in pixels in a substantially similar way.

The drawings referenced above and the detailed description of certain embodiments of the present invention are provided as examples of the present invention and are used to explain the present invention, not to limit meanings or the scope of the present invention described in the appended claims. Therefore, those skilled in the art may easily implement modifications from those described above. Further, those skilled in the art may remove some of the components described herein without deterioration of the performance or may add other components to improve the performance. In addition, those skilled in the art may change the order of the processes of the methods described herein, depending on the environment of the process or the equipment. Therefore, the scope of the present invention should be determined by not the exemplary embodiments described above, but by the appended claims and their equivalents.

| <Description of symbols> | |
|---|---|
| 10: Display unit | 20: Scan driver |
| 30: Data driver | 40: Timing controller |
| 50: Power controller | |
| 60: Compensation control signal unit | |
| 70, 70-1: Pixel | |

What is claimed is:

1. A display device comprising:

a data driver configured to transmit a plurality of data signals;

a scan driver configured to generate and transmit a plurality of scan signals;

a compensation control signal unit configured to reset voltages of data signals transmitted to a plurality of pixels during a previous frame at a current frame, and configured to generate and transmit a first control signal to compensate for threshold voltages of driving transistors of the pixels and a second control signal to control simultaneous light emission of the pixels;

a power controller configured to control and supply a first power source voltage and a second power source voltage;

a display unit comprising the plurality of pixels coupled to corresponding ones of a plurality of data lines configured to transmit the plurality of data signals, to corresponding ones of a plurality of scan lines configured to transmit the plurality of scan signals, to a first control line configured to transmit the first control signal, to a second control line configured to transmit the second control signal, to a first voltage line configured to transmit the first power source voltage, and to a second voltage line configured to transmit the second power source voltage; and a timing controller configured to generate the plurality of data signals by processing external image signals and generate a plurality of driving control signals for controlling driving of each of the data driver, the scan driver, the compensation control signal unit, and the power controller.

2. The display device of claim 1, wherein the compensation control signal unit is further configured to generate and transmit a third control signal for controlling transmission of data voltages stored in the plurality of pixels according to the data signals of the previous frame to gate electrodes of the driving transistors of the pixels.

3. The display device of claim 1, wherein the scan driver is further configured to sequentially transmit the plurality of scan signals to corresponding scan lines of corresponding pixel lines of the plurality of pixels, and the data driver is further configured to sequentially transmit corresponding data signals of the current frame through the plurality of data lines to the plurality of pixels respectively activated by the plurality of scan signals.

4. The display device of claim 1, wherein the plurality of pixels in the display unit are configured to simultaneously display images according to data voltages according to corresponding ones of the plurality of data signals of the current frame in response to the second control signal.

5. The display device of claim 1, wherein the scan driver is further configured to sequentially transmit the scan signals to scan lines corresponding to pixel lines of the plurality of pixels, and the data driver is further configured to sequentially transmit corresponding ones of the plurality of data signals of the current frame to the plurality of pixels respectively activated by the plurality of scan signals during a first period, the pixels in the display unit are configured to simultaneously display images according to the plurality of data signals programmed during the previous frame according to the second control signal during a second period, the second period overlapping the first period.

6. The display device of claim 5, wherein the second period is the same as the first period.

7. The display device of claim 1, wherein the data signals are first view point image data signals or second view point image data signals and correspond to the current frame, and the view points of the first image data signals and the second image data signals are different from each other.

8. The display device of claim 1, wherein each of the plurality of pixels comprise:

an organic light emitting diode;

a driving transistor electrically coupled to the first voltage line and configured to supply a driving current to the organic light emitting diode;

a switching transistor coupled to the corresponding data line and configured to transmit a data voltage according to the data signal of the current frame to a gate electrode of the driving transistor;

a compensation transistor coupled to a gate electrode and a drain electrode of the driving transistor and configured to diode-connect the driving transistor for a period in one frame;

a light emission control transistor coupled between the driving transistor and the organic light emitting diode and configured to control supply of the driving current;

a compensation capacitor coupled to the gate electrode of the driving transistor; and a storage capacitor comprising one electrode coupled to the compensation capacitor and another electrode coupled to the first voltage line, and the organic light emitting diodes of the pixels configured to simultaneously emit light for a first period when the light emission control transistors are turned on.

9. The display device of claim 8, wherein the plurality of pixels each further comprise:

a transmission transistor located between the switching transistor and a node coupling the storage capacitor and the compensation capacitor, and configured to transmit, during the current frame, a data voltage of the data signal of the previous frame through the switching transistor;

a holding transistor located between the corresponding data line and the node and configured to apply a reference voltage through the data line to the node; and a holding capacitor comprising one electrode coupled to a source electrode of the transmission transistor and another electrode coupled to a gate electrode of the holding transistor, and configured to store a data voltage according to the data signal of the current frame for a time.

10. The display device of claim 9, wherein each of the plurality of pixels are configured to simultaneously emit light during a light emission period of the current frame according to a data voltage according to the data signal of the previous frame which is transmitted by the transmission transistor, and configured to simultaneously emit light during a light emission period of a next frame according to a data voltage according to the data signal of the current frame which is stored by the holding capacitor.

11. The display device of claim 9, wherein the holding transistor is configured to be turned on and apply the reference voltage to the node for the period when the voltages according to the data signals of the previous frame are reset.

12. The display device of claim 8, wherein a fourth period when the light emission transistor is turned off comprises:

a reset period when the voltages according to the data signals of the previous frame are reset;

a compensation period when the threshold voltages of the driving transistors of the pixels are compensated for, and a writing period when the pixels are activated by scan signals and the data voltages according to the data signals of the current frame are programmed.

13. The display device of claim 8, wherein a fifth period when the light emission transistor is turned off comprises:

a reset period when the voltages according to the data signals of the previous frame are reset;

a compensation period when the threshold voltages of the driving transistors of the pixels are compensated for; and a transmission period when the data voltages according to the data signals programmed and stored during the previous frame are transmitted to the gate electrodes of the driving transistors of the pixels, and the first period overlaps a writing period when the pixels are activated by scan signals and the data voltages according to the data signals of the current frame are programmed.

14. The display device of claim 8, wherein the switching transistor is configured to be turned on and transmit a reference voltage to the gate electrodes of the driving transistors through the corresponding data lines during the period when the voltages according to the data signals of the previous frame are reset, before transmitting the data voltages according to the data signals of the current frame.

15. A pixel comprising:

an organic light emitting diode;

a first transistor electrically coupled to a first power source voltage and configured to supply a driving current to the organic light emitting diode;

a second transistor coupled to a corresponding one of a plurality of data lines and configured to transmit a data voltage according to a data signal of one frame to a gate electrode of the first transistor;

a third transistor coupled to a gate electrode and a drain electrode of the first transistor and configured to diode-connect the first transistor for a period in one frame;

a fourth transistor coupled between the first transistor and the organic light emitting diode and configured to control supply of the driving current;

a first capacitor coupled to the gate electrode of the first transistor; and a second capacitor comprising one electrode coupled to the first capacitor and another electrode coupled to the first power source voltage, wherein while the fourth transistor is turned off, a voltage according to a data signal of a previous frame is reset, the third transistor is turned on and a threshold voltage of the first transistor is compensated for, and the second transistor is configured to be turned on and a data voltage according to a data signal of the one frame is programmed, and while the fourth transistor is turned on, the organic light emitting diode is configured to emit light according to the driving current, and wherein the first power source voltage is supplied as a low-level voltage during the period when a voltage according to a data signal of the previous frame is reset.

16. The pixel of claim 15, wherein the second transistor is configured to be turned on and transmit a reference voltage through the corresponding data line during the period when a voltage according to a data signal of the previous frame is reset.

17. The pixel of claim 16, wherein the reference voltage has a value in a range according to the data signal.

18. The pixel of claim 15, wherein during the one frame, a second power source voltage coupled to a cathode of the organic light emitting diode is supplied fixedly as a low-level voltage.

19. A pixel comprising:

an organic light emitting diode;

a fifth transistor electrically coupled to a first power source voltage and configured to supply a driving current to the organic light emitting diode;

a sixth transistor coupled to a corresponding one of a plurality of data lines and configured to transmit a data voltage according to a data signal of one frame to a gate electrode of the fifth transistor;

a seventh transistor coupled to a gate electrode and a drain electrode of the fifth transistor and configured to diode-connect the fifth transistor for a period in the one frame;

an eighth transistor coupled between the fifth transistor and the organic light emitting diode and configured to control supply of the driving current;

a third capacitor coupled to the gate electrode of the fifth transistor;

a fourth capacitor comprising one electrode coupled to the third capacitor and another electrode coupled to the first power source voltage;

a ninth transistor located between the sixth transistor and a node coupling the third capacitor and the fourth capacitor, and configured to transmit a data voltage of the data signal of a previous frame of the one frame which is applied through the sixth transistor;

a tenth transistor located between the corresponding data line and the node and configured to apply a reference voltage transmitted through the data line to the node; and a fifth capacitor comprising one electrode coupled to a source electrode of the ninth transistor and another electrode coupled to a gate electrode of the tenth transistor, and configured to store a data voltage according to the data signal of the one frame for a time, wherein while the eighth transistor is turned on, the organic light emitting diode is configured to emit light according to the driving current.

20. The pixel of claim 19, wherein while the eight transistor is turned off, a voltage according to a data signal of the previous frame of the one frame is reset, the seventh transistor is configured to be turned on and a threshold voltage of the fifth transistor is compensated for, and the ninth transistor is configured to be turned on and a data voltage according to a data signal of the previous frame is transmitted.

21. The pixel of claim 20, wherein the first power source voltage is supplied as a low-level voltage during the period when a voltage according to a data signal of the previous frame of the one frame is reset.

22. The pixel of claim 19, wherein while the eighth transistor is turned on, the sixth transistor is configured to be turned on and a data voltage according to the data signal of the one frame is programmed through the corresponding data line.

23. The pixel of claim 19, wherein the reference voltage that the tenth transistor transmits has a value in a range according to the data signal.

24. The pixel of claim 19, wherein during the one frame, a second power source voltage coupled to a cathode of the organic light emitting diode is supplied fixedly as a low-level voltage.

25. A method of driving a display device comprising a plurality of pixels, each pixel comprising an organic light emitting diode; a driving transistor coupled to a first power source voltage and supplying a driving current to the organic light emitting diode; a light emission control transistor located between the driving transistor and the organic light emitting diode and controlling light emission by the driving current; a compensation capacitor coupled to a gate electrode of the driving transistor; and a storage capacitor located between the compensation capacitor and first power source voltage, the method comprising:

a reset act comprising discharging an anode voltage of the organic light emitting diode and applying a reference voltage to a gate electrode of the driving transistor;

a compensation act comprising transmitting a voltage corresponding to a threshold voltage of the driving transistor to the compensation capacitor;

a scan act comprising storing a data voltage according to a corresponding one of a plurality of data signals of one frame, into the storage capacitor; and a light emission act comprising emitting light through the organic light emitting diode according to a driving current corresponding to the voltage applied to the gate electrode of the driving transistor, wherein the light emission control transistors of the pixels are simultaneously turned on and the light emission act of the pixels is simultaneously performed.

26. The method of claim 25, wherein while the light emission control transistors of the pixels are simultaneously turned off, the reset act, the compensation act, and the scan act are performed.

27. The method of claim 25, wherein while the light emission control transistors of the pixels are simultaneously turned off, the reset act and the compensation act are performed, and while the light emission control transistors of the pixels are simultaneously turned on, the light emission act of the pixels overlaps the scan act sequentially performed on each pixel line of the pixels.

28. The method of claim 27, further comprising a transmission act comprising transmitting data voltages programmed according to the data signals of a previous frame in the pixels to the gate electrodes of the driving transistors of the pixels, after the compensation act.

29. The method of claim 27, wherein the pixels each emit light with a driving current according to the data voltage programmed according to the data signal of a previous frame during the simultaneous light emission act, and receive and store a data voltage according to the data signal of the one frame in the scan act.

30. The method of claim 25, wherein the first power source voltage is supplied as a low-level voltage during the reset act.

31. The method of claim 25, wherein while the reset act, the compensation act, the scan act, and the light emission act are performed, a second power source voltage coupled to a cathode of the organic light emitting diode is supplied fixedly as a low-level voltage.

* * * * *